US007445506B2

(12) United States Patent
Ma

(10) Patent No.: US 7,445,506 B2
(45) Date of Patent: Nov. 4, 2008

(54) SHIELDED CONNECTOR

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/006,869

(22) Filed: Jan. 7, 2008

(65) Prior Publication Data

US 2008/0166921 A1 Jul. 10, 2008

(30) Foreign Application Priority Data

Jan. 8, 2007 (TW) ..... 96200294 U

(51) Int. Cl.
*H01R 13/648* (2006.01)

(52) U.S. Cl. ..... 439/607; 439/609

(58) Field of Classification Search ..... 439/608, 439/609, 607, 108, 496
See application file for complete search history.

(56) References Cited

U.S. PATENT DOCUMENTS 7,147,481 B2 * 12/2006 Yang ..... 439/71
7,232,316 B2 * 6/2007 Chen ..... 439/71
7,309,238 B2 * 12/2007 Yang ..... 439/71

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector (1) comprises a metal housing (10) configured by first, second, third and fourth sidewalls (100, 101, 102, 103) defining a receiving space (104) therebetween, first and second insulating housings (20) securely attached to the first and third sidewalls of the metal housing respectively, a plurality of contacts (30) securely attached to the insulating housing, first and second metal shield (40) assembled to the first and second insulating housing, and a fastening means (50) extending from the metal shield, through the insulating housing and anchored to the first and third sidewalls of the metal housing, respectively.

13 Claims, 3 Drawing Sheets

SHIELDED CONNECTOR

BACKGROUND OF THE INVENTION

1. Field of the Invention

The present invention relates to a shielded connector, and more particularly to a module connector for interconnecting a module such as a camera module for use with a cellular phone or the like to an electrical member such as a printed circuit board.

2. Description of the Related Art

Conventionally, electronic modules such as a camera module for use with a cellular phone are securely maintained in electrical connection with an electronic member such as a printed circuit board. Therefore, an electrical connector for the camera module, formed in a shape that allows for secure insertion of the camera module, is pre-installed on the printed circuit board. Then, the camera module is inserted into the electrical connector to engage therewith. Consequently, the camera module is electrically connected with the printed circuit board via the electrical connector.

For example, known as an example of the aforementioned conventional technique is a camera module connector which is described in U.S. Patent Application Publication No. 2006-0216996. This connector comprises a metal housing configured by first, second, third and fourth sidewall defining a receiving space therebetween, a pair of insulating housings securely attached to the first and third sidewalls respectively, a plurality of terminals securely attached to said insulating housings, and a pair of metal shield assembled with the insulating housings, respectively. Each insulating housing defines a pair of locking holes and a pair of retention holes beside each locking hole, the metal housing defines a pair of locking tabs corresponding to the locking holes of the insulating housing, and each metal shield defines a pair of retention tabs corresponding to the retention holes of the insulating housing. A plurality of resilient fingers are formed on each sidewall of the metal housing, respectively, and extending into the receiving space. In assembly, the insulating housings are attached on the first and third sidewalls of the metal housing via interference engagement between the locking tabs and the locking holes, then the metal shield are assembled on each insulating housing via interference engagement between the retention tabs of metal shield and the retention holes of the insulating housing. Therefore, the metal housing, the insulating housings, and the metal shields are assembled together.

However, said electrical connector has many members assembled by the interference engagement. Therefore, it is apt to fall apart in the course of use, and further the electrical connection may be unstable.

Thus, there is a need to provide an improved shielded connector that overcomes the above-mentioned problems.

BRIEF SUMMARY OF THE INVENTION

It is an object of the present invention to provide an shielded connector with a steady connection.

In order to achieve the objective above, an shielded connector in accordance with a preferred embodiment of the present invention comprises a metal housing configured by first, second, third and fourth sidewalls defining a receiving space therebetween, first and second insulating housings securely attached to the first and third sidewalls of the metal housing respectively, a plurality of contacts securely attached to the insulating housing, first and second metal shield assembled to the first and second insulating housing, and a fastening means extending from the metal shield, through the insulating housing and anchored to the first and third sidewalls of the metal housing, respectively.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

Figure 1:
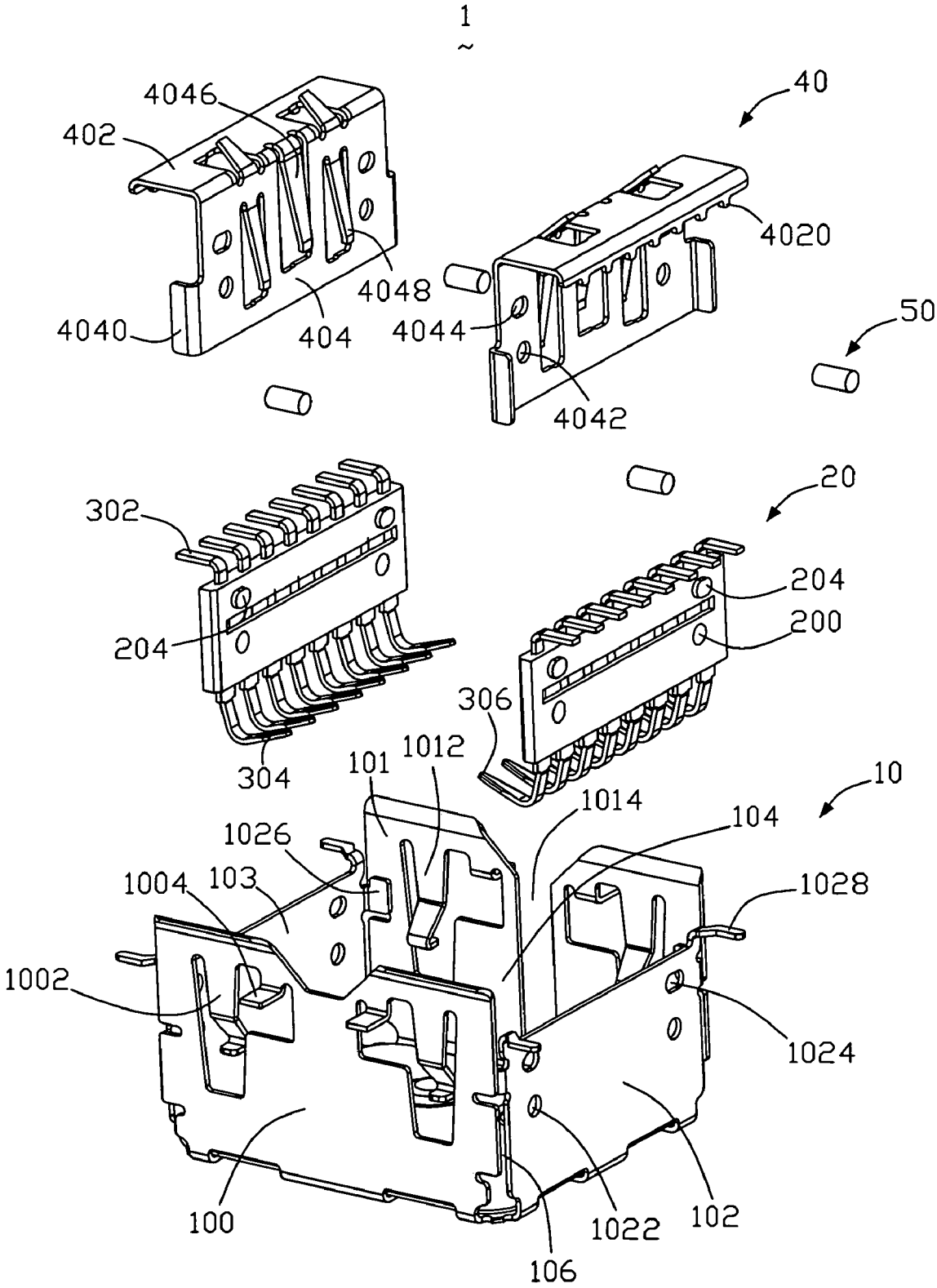
FIG. 1 is an exploded view of an shielded connector of the present invention, wherein the contacts are assembled with the insulating housing.

In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

An shielded connector according to the present invention is applicable to an electronic apparatus such as digital cameras, PDAs (Personal Digital Assistants), PCs (Personal Computers), mobile phones or the like. In the preferred embodiment illustrated in FIGS. 1-3, the shielded connector 1 is used in a mobile handset (not shown) for connecting a camera module (not shown) to a PCB (not shown).

FIG. 1 is an exploded perspective view of the shielded connector for receiving a camera module in the embodiment of this invention. In the figure, the reference numeral 10 denotes a metal housing made of a metal material. The reference numeral 20 denotes a pair of insulating housings made of insulating material and the reference numeral 40 denotes a pair of metal shield made of metal material.

The metal housing 10 is made of metal material and configured by first 102, second 101, third 103, and fourth 100 sidewall defining a receiving space 104 therebetween. The metal housing 10 further includes a bottom wall (not labeled) connecting the first 102, second 101, third 103, and fourth 100 sidewalls. Wherein the second 101 and fourth 100 sidewalls have a section higher than the first 102 and third 103 sidewalls.

A window 1014 is provided on a second sidewall 101 for engaging with a corresponding portion of the camera module in order to prevent the camera module from being wrongly received in the receiving space 104. A plurality of locking fingers 1002, 1012 extend from the second and fourth sidewalls 101, 100 inward to the receiving space 104 to contact with and retain the camera module. The first and third sidewall 102, 103, separately, has a number of first holes 1022 and first retaining holes 1024, which are arranged in two rows and run through the metal housing 10. A retaining portion 1026 is formed on the two ends of the first and third sidewalls 102, 103 in order to resist the end portion of the insulating housing 20. A plurality of soldering portions 1004, 1028, extend outwardly from the first, second, third, and fourth sidewalls 102, 101, 103, 100 along the horizontal direction in order to mount on the printed circuit board.

Referring again to FIG. 1, each insulating housing 20 is made of insulating material and configured as a flat plate. The insulating housings 20 are assembled on the first and third sidewalls 102, 103 of the metal housing 10, respectively, by a number of second holes 200 corresponding with the first holes 1022, and a plurality of retaining sections 204 on a side thereof corresponding with the first retaining holes 1024 and also on an opposite side thereof.

A plurality of contacts 30 are configured in a "Z"-shape, each comprising a vertical section (not labeled) insert molded with the insulating housing 20, a soldering section 302 extending upwardly and outwardly from one end of the vertical section in order to mount on the printed circuit board, and a contact section 304 extending downwardly and slantly from the other end of the vertical section with a contact portion 306 to contact with electrical pads formed on the bottom surface of the camera module.

Each metal shield 40 mounted on the first and third sidewalls 102, 103 of the metal housing 10 comprises a vertical body portion 404 and a horizontal portion 402 extending laterally from an upper edge of the vertical body portion 404. The vertical body portion 404 has a flexible finger 4046 and a pair of resilient fingers 4048 located on two sides of the flexible finger 4046, all protruding inwardly for pressing the camera module. The vertical body portion 404 further comprises a pair of skirt portion 4040 to connect with the metal housing 10 by spot welding. The horizontal portion 402 has a plurality of soldering pads 4020 on the end thereof so as to connect to the printed circuit board. Furthermore, the vertical body portion 404 has a pair of third holes 4042 corresponding with the first holes 1022 of the metal housing 10 and the second holes 200 of the insulating housing 20, and a pair of second retaining holes 4044 corresponding with the first retaining holes 1024 of the metal housing 10 and the retaining section 204 of the insulating housing 20.

The shielded connector 1 further comprises a plurality of fastening means, such as a retaining stick 50, which penetrates the first holes 1022 of the metal housing 10, the second holes 200 of the insulating housing 20, and the third holes 4042 of the metal shield 40 in turn so as to provide a steady connection therebetween via interference engagement.

Figure 2:
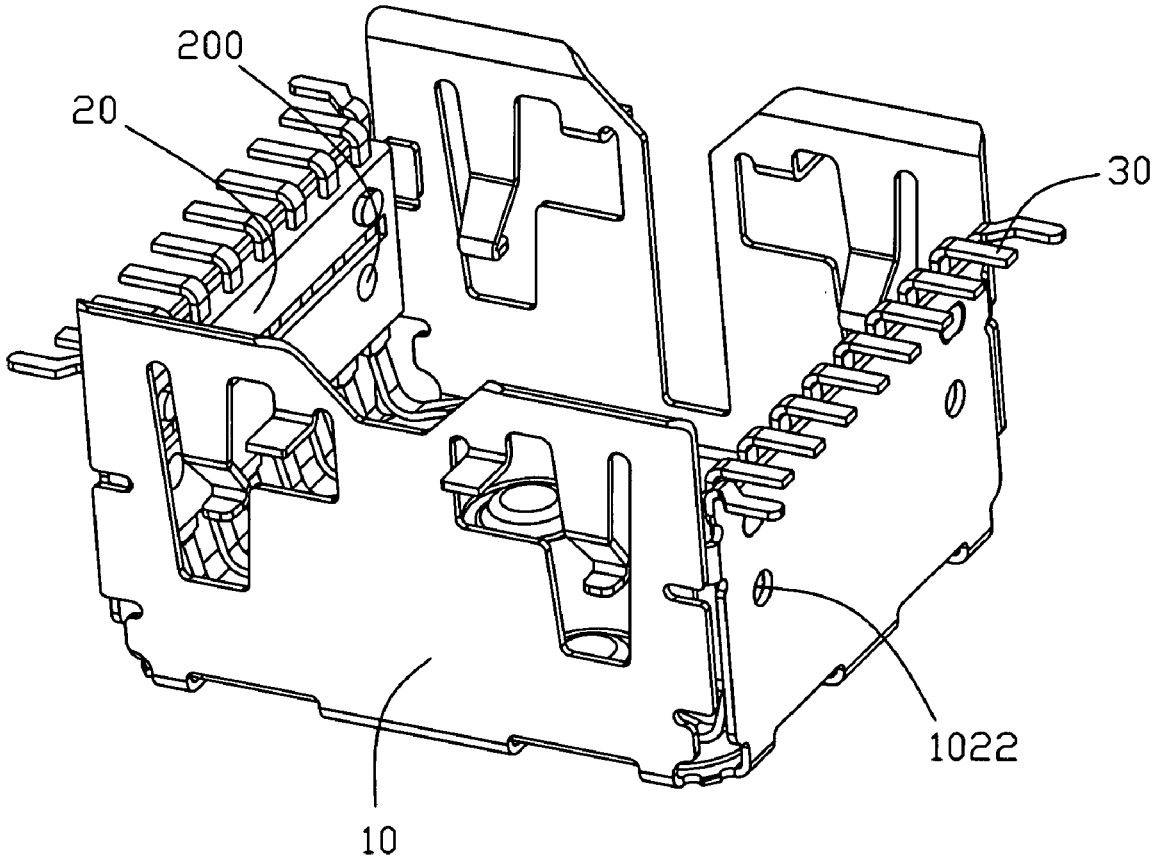
FIG. 2 is a partly assembled perspective view of the shielded connector of the present invention.
Figure 3:
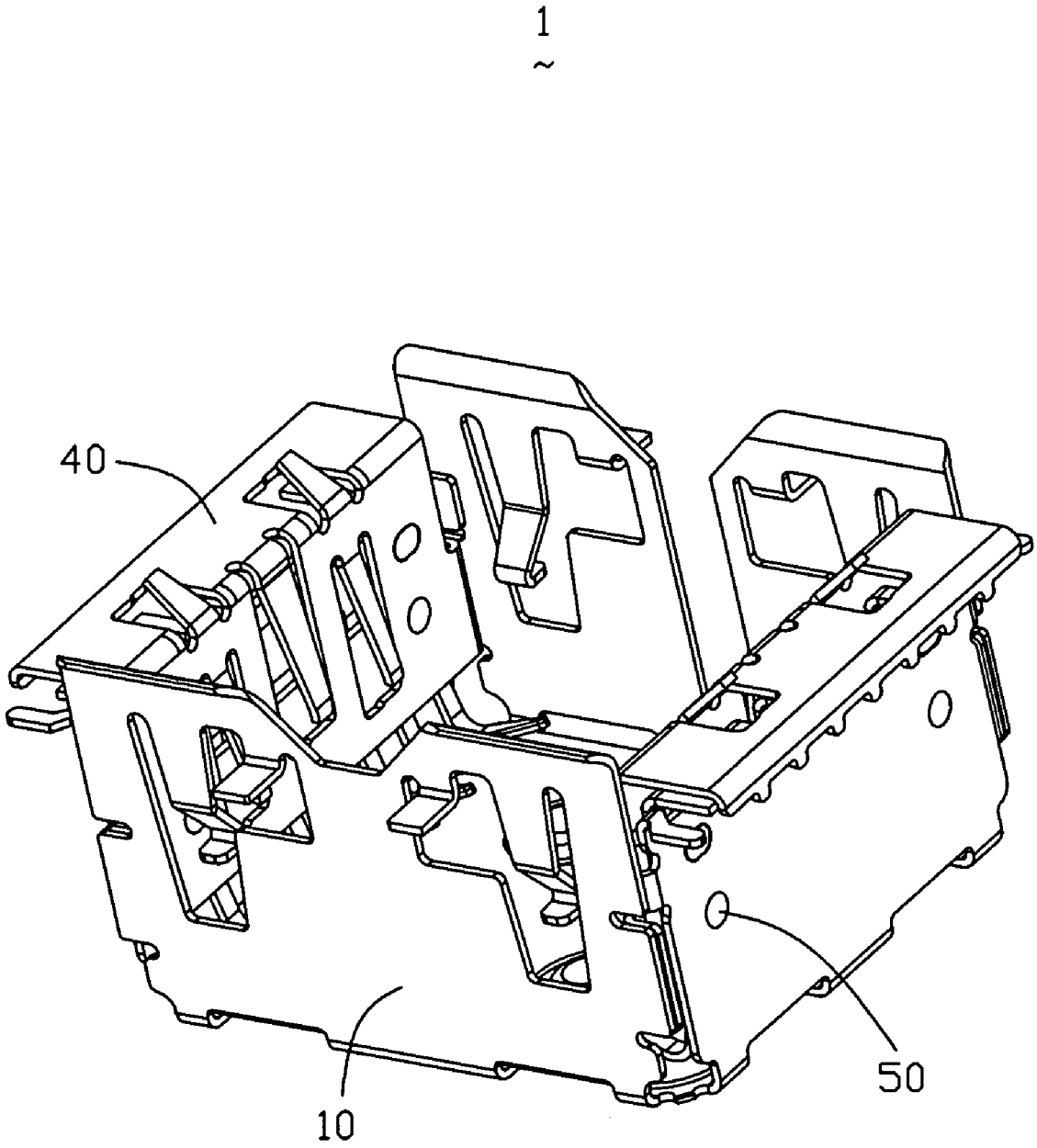
FIG. 3 is a perspective view of the shielded connector of the present invention.

Referring to FIGS. 2 and 3, in assembling the shielded connector 1, firstly, the contacts 30 are assembled with the insulating housing 20 by insert molding. Secondly, the insulating housings 20 with the contacts 30 and the metal shield 40 are mounted on the first and third sidewalls 102, 103 of the metal housing 10, with the retaining sections 204 of the insulating housing being inserted into the first retaining holes 1024 of the metal housing 10 and the second retaining holes 4044 of the metal shield 40 and with the retaining portions 1026 of the metal housing 10 bearing against the two ends of the insulating housings 20 and the skirt portion 4040 of the metal shield 40 bearing against the second and fourth sidewalls 100, 101 of the metal housing 10 and being connected with the metal housing 10 by spot welding. The contact sections 304 of the contacts 30 extend into the receiving space 104 of the metal housing 10 so as to contact with the electrical pads formed on the bottom face of the camera module and the soldering sections 302 extend outwardly of the insulating housings 20 so as to connect to the printed circuit board. Then, the retaining sticks 50 penetrate the first holes 1022 of the metal housing 10, the second holes 200 of the insulating housing 20, and the third holes 4042 of the metal shield 40 in turn by interference fit.

When the camera module is inserted into the receiving space 104 from above, the contact pads on the bottom faces thereof are brought into contact with the contact sections 304 of the contacts 30, and the locking fingers 1002, 1012 of the metal housing 10, the flexible finger 4046 and the resilient fingers 4048 of the metal shield 40 contact with the outer periphery of the camera module so as to hold the camera module in the receiving space 104 steadily. Therefore, the camera module is electrically connected to the printed circuit board via the contacts 30. Finally, the shielded connector 1 with the camera module is connected to the printed circuit board by the soldering portions 1004, 1028, of the metal housing 10, the soldering sections 302 of the contacts 30, and the soldering pads 4020 of the metal shield 40.

In the above description of the preferred embodiment, the shielded connector further includes a fastening means which penetrates the first holes of the metal housing, the second holes of the insulating housing, and the third holes of the metal shield by interference engagement so as to provide a steady connection therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A shielded connector comprising:

a metal housing configured by first, second, third and fourth sidewalls defining a receiving space therebetween;

first and second insulating housings securely configured as a flat plate and attached to the first and third sidewalls of the metal housing, respectively;

a plurality of contacts securely attached to the insulating housings, and each contact is configured in a "Z"-shape and each contact has a vertical section inserts molded with the insulating housing and having a tail portion extending away from insulating housing, and a soldering section extending upwardly and outwardly from one end of the vertical section in order to mount on the printed circuit board, and a contact engaging section extending downwardly and slantly from the other end of the vertical section toward a center of the receiving space of the metal housing with the contact engaging portion to contact with electrical pads formed on the bottom surface of a camera module;

first and second metal shields assembled to the first and second insulating housings; and a plurality of fastening means are retaining rod/nails extending through first holes from the metal shield, through second holes of the corresponding insulating housing and anchored through to third holes of the corresponding one of the first and third sidewalls of the metal housing, respectively, in turn so as to provide a steady connection therebetween via interference engagement.

2. The shielded connector as recited in claim 1, wherein the fastening device is discrete from both the metal housing and one of the side walls.

3. The shielded connector as recited in claim 2, wherein the insulating housing is pre-molded with the second holes for receiving the retaining rod/nail.

4. The shielded connector as recited in claim 2 wherein the vertical body portion of the metal shield has a flexible finger and a pair of resilient fingers located on two sides of the flexible finger, and protruding inwardly for pressing the camera module.

5. The shielded connector as recited in claim 4, wherein the first and third sidewall of the metal shield is defined with a the first holes in aligning the retaining rod/nail.

6. The shielded connector as recited in claim 2, wherein the second and fourth sidewalls have a section higher than the first and third sidewall.

7. The shielded connector as recited in claim 6, wherein each of the metal shields includes resilient fingers extending into the receiving space of the metal housing.

8. The shielded connector as recited in claim 7, wherein each of the second and fourth sidewalls includes locking fingers extending into the receiving space of the metal housing.

9. The shielded connector as recited in claim 8, wherein each metal shield includes a horizontal portion substantially covering the tail portion of the contact.

10. The shielded connector as recited in claim 8, wherein the metal shield further comprising a pair of skirt portions substantially covering against the second and fourth sidewalls of the metal housing.

11. An electrical connector comprising:

a metallic shield; configured by first, second, third and fourth sidewalls defining a receiving space therebetween;

first and second insulating housings securely configured as a flat plate and attached to the first and third sidewalls of the metal shield, respectively;

a plurality of contacts securely embedded within the insulating housings, and each contact is configured in a "Z"-shape and each contact has a vertical section inserts molded with the insulating housing and—having a tail portion extending away from insulating housing, and a soldering section extending upwardly and outwardly from one end of the vertical section in order to mount on the printed circuit board, and a contact engaging section extending downwardly and slantly from the other end of the vertical section toward a center of the receiving space of the metal shield with the contact engaging portion to contact with electrical pads formed on the bottom surface of a camera module;

first and second metal shells including a vertical plate cooperating with selected one of said side walls to sandwich the insulating housings therebetween; and a plurality of fastening means are retaining bud/posts extending through first holes from the metal shells, through second holes of the corresponding insulating housing and anchored through to third holes of the corresponding one of the first and third sidewalls of the metal shield, respectively, in turn so as to provide a steady connection therebetween via interference engagement.

12. The electrical connector as claimed in claim 11, wherein the insulating housing is pre-molded with the aligning bud/post.

13. The electrical connector assembly as claimed in claim 12, wherein the fastening device is discrete from both the shield and the one of the side walls.

* * * * *